US006048245A

United States Patent [19]

Forti et al.

[11] Patent Number: 6,048,245

[45] **Date of Patent: *Apr. 11, 2000**

[54] GYROSCOPIC FLYING DEVICE

[75] Inventors: William B. Forti; William Mark Forti, both of Claremont, Calif.

[73] Assignee: William Mark Corporation, Claremont, Calif.

[ * ] Notice: This patent is subject to a terminal disclaimer.

[21] Appl. No.: 09/160,883

[22] Filed: Sep. 25, 1998

Related U.S. Application Data

[63] Continuation-in-part of application No. 08/573,241, Dec. 15, 1995, Pat. No. 5,816,880, which is a continuation-in-part of application No. 08/139,513, Oct. 19, 1993, abandoned, which is a continuation-in-part of application No. 07/827,091, Jan. 21, 1992, abandoned.

[51] Int. Cl.[7] ..... A63H 27/08

[52] U.S. Cl. ..... 446/61

[58] Field of Search ..... 446/34, 61, 68, 446/71; 273/424, 425, 428; 244/34 A, 153 R

[56] References Cited

U.S. PATENT DOCUMENTS

| | | | |
|---|---|---|---|
| 4,151,674 | 5/1979 | Klahn et al. | 446/61 |
| 4,390,148 | 6/1983 | Cudmore | 244/19 |
| 4,790,788 | 12/1988 | Hill | 446/61 |
| 5,352,144 | 10/1994 | Kuhn | 446/176 |
| 5,397,261 | 3/1995 | Malewicki et al. | 446/71 |
| 5,810,637 | 9/1998 | Mileti | 446/61 |

*Primary Examiner*—Kien T. Nguyen
*Attorney, Agent, or Firm*—Crockett & Fish; Robert D. Fish

[57] ABSTRACT

A free spinning gyroscopic device has a hollow body with leading and following open ends, in which the outside perimeter of the leading open end has particular relationships to other characteristics of the device. In one aspect, the perimeter may advantageously measure at least 600, 800, 1000, 2000, 3000 or 4000 times the average thickness of the leading edge, or 150, 200, 250, 500, 750, or 1000 times the point of greatest thickness of the body. In another aspect, the perimeter may advantageously measure at least 4.7, 5.0, 7.5 or 10, times the length of the body. In another aspect, the perimeter may advantageously measure at least 9 inches, 12 inches, 15 inches, or 20 inches.

20 Claims, 5 Drawing Sheets

GYROSCOPIC FLYING DEVICE

This is a continuation-in-part of U.S. application Ser. No. 08/573,241, filed Dec. 15, 1995, to be issued as U.S. Pat. No. 5,816,880, which is a continuation-in-part of U.S. application Ser. No. 08/139,513 filed Oct. 19, 1993, now abandoned, which is a continuation-in-part of application Ser. No. 07/827,091 filed Jan. 21, 1992, now abandoned.

BACKGROUND OF THE INVENTION

1. Field of the Invention

This invention relates to gyroscopic flying devices.

2. Description of the Prior Art

The prior art discloses various tubular devices having a longitudinal axis, which are thrown through the air with a spinning motion in the direction of the longitudinal axis.

An early example was disclosed in U.S. Pat. No. 3,264,776 to Morrow (February 1966). In Morrow, a straight, hollow tube with unbalanced weighting toward the leading end is propelled with a rotational motion about its longitudinal axis. A slight taper extends from the trailing end to the leading end on both the interior and external surfaces of the tube. The tube is provided with a forward annular weighted area, such that its center of gravity is located within the leading one-half to one-third of the tube. The ratio of length to diameter (L/D) is also considered to be important, with the greatest stability occurring where L/D is around 1:1 to 1:2.

U.S. Pat. No. 4,151,674 to Kahn, et al. (May 1979) claims improved aerodynamic performance by incorporating a ledge along the forward edge of the cylindrical body. The rearwardly directed ledge is claimed to reduce drag and move the center of gravity to the forward quarter of the total length. Best performance in Kahn type devices was reported with the center of gravity placed at about 25% of the distance from the leading edge.

U.S. Pat. No. 4,246,721 to Bowers (January 1981) teaches the use of an annular recess on the outer surface of the hollow body adjacent the leading edge, together with an annular ridge formed on the adjacent inner wall. In addition, a weighted annular ring is adjustably positioned within the cylinder to permit ready modification of the center of gravity. Modification of the center of gravity is said to change the aerodynamic characteristics so as to produce several curvilinear flight paths.

U.S. Pat. No. 4,790,788 to Hill (December 1988) states that the above-cited devices have not had much commercial impact because desired aerodynamic characteristics are easily lost, and that the prior devices have erratic, unpredictable and inconsistent flight characteristics. He allegedly achieves consistent flight by improving aerodynamic characteristics in a dimensionally constrained design by placing a relatively thick peripheral ring at the laden edge of a short tube body. In addition, the leading edge of the ring is chamfered while the trailing edge fairs smoothly into the rear portion of the tube. Hill further states that the L/D ratio must be held between 0.8 and 0.74, and the ratio of leading end to trailing end weight must be about 2.2. These requirements place the center of gravity at substantially the intersection of the forward and rearward body sections.

U.S. Pat. No. 4,850,923 to Etheridge (July 1989) also notes limitations and short-comings of prior art devices. He claims to improve flight by further improvements to design parameters. Among other things, Hill teaches devices in which the outer surface inclines radially outward and rearward at a 16-degree angle in order to increase lift. Hill also teaches that the ratio of leading area weight to trailing area weight should be substantially between 2.2:1 to 2.5:1, which corresponds to an L/D ratio of about 0.86.

In 1992 the present applicants filed U.S. patent application Ser. No. 07/827,091. The grandchild of that application, U.S. Pat. No. 08/573,241, is expected to issue in 1998 as U.S. Pat. No. 5,816,880. In U.S. Pat. No. 08/573,241, the present applicants disclose that superior flight characteristics are obtained through the combination of D/L ratio $\geqq 1.5$ (L/D<about 0.66) and a center of gravity at least 70% of the distance from the following end to the leading end. It was also disclosed that it is advantageous for the weighted portion to have a thickness of $\leqq 0.4$ inches, and for both the leading edge and the trailing, non-weighted region to have a thickness of $\leqq 0.1$ inches.

Embodiments disclosed in the 1992 disclosure are commercially successful in the toy markets of many countries. However, further improvements in the toy markets, and especially expansion into commercial and military markets, requires a greater understanding of the interactions among the various parameters than has previously been set forth.

SUMMARY OF THE INVENTION

The present invention is directed to free spinning gyroscopic devices in which a hollow body has leading and following open ends, and the outside perimeter of the leading open end has particular relationships to other characteristics of the device. In one class of preferred embodiments the leading edge outside perimeter is at least 600, 800, 1000, 2000, 3000, or 4000 times the average thickness of the leading edge, or 150, 200, 250, 500, 750, or 1000 times the point of greatest thickness in the body. In another class of preferred embodiments, the leading edge outside perimeter is at least 4.7, 5.0, 7.5, or 10 times the length of the body. In yet another class of preferred embodiments, the leading edge outside perimeter measures at least 9 inches, 12 inches, 15 inches, or 20 inches. Especially preferred embodiments also have an axial center of gravity positioned between the leading and following ends, wherein the center of gravity is at least 70%, 80% or 90% of the distance from the following end to the leading end.

Objects, features and advantages of the present invention will become more apparent when making reference to the following detailed description and to the accompanying sheets of drawings in which preferred structural embodiments incorporating the principles of this invention are shown.

DETAILED DESCRIPTION OF THE PREFERRED EMBODIMENT

Figure 1:
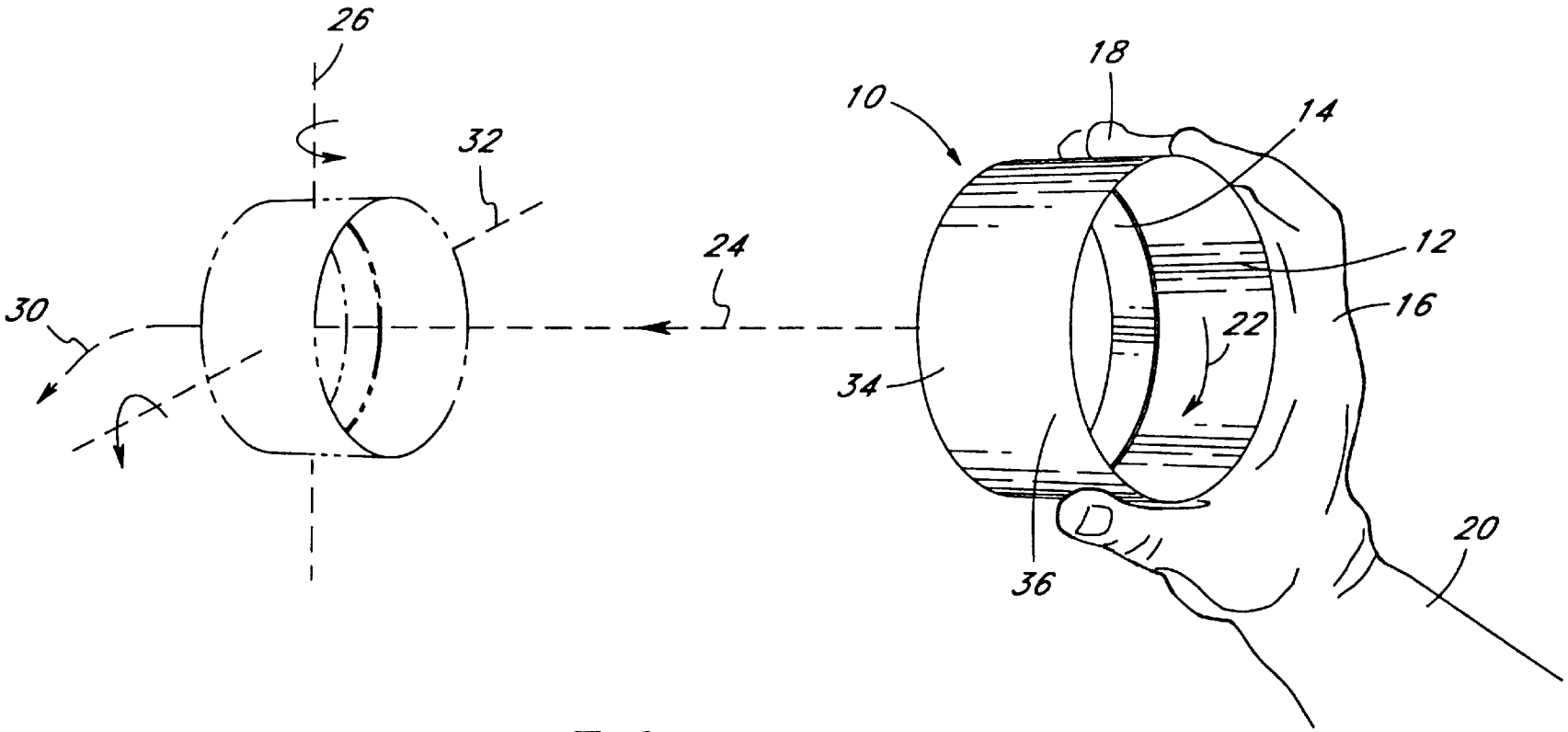
FIG. 1 is a rear perspective view illustrating the operation of a gyroscopic flying device in accordance with the present invention as an aerial sports toy which is manually propelled.

FIG. 1 generally depicts operation of a gyroscopic flying body 10, as thrown by a hand 16 as an aerial sports toy. The body 10 comprises a hollow cylinder or "wing" 12 having a leading end 34 and a trailing end 36. A dense and weighted rim 14 is shown attached to the interior of the cylinder 12 at the leading end 34. The body 10 is shown being manually held by a to hand 16 just prior to launch. When the body 10 is thrown by the hand 16, gripping fingers 18 work in cooperation with a wrist 20 to impart axial spin to the device in the direction illustrated by arrow 22. At the same time, the hand 16 provides an initial forward velocity along spin axis 24. It is anticipated that manual usage will include games of catch or competition events in which throwers aim for maximum flight times, distance or accuracy.

The forward rim 14 is preferably made of spring steel that allows for resiliency when gripped by hand 16. The rim may be formed into a ring by bending the spring steel in a circular fashion and fastening it by a weld adhesive, or by mechanical means. The rim 14 may be heavily coated with any number of plastic coatings to avoid exposure of sharp edges and provide of safety. The cylinder 12 of the body 10 can be constructed by adhering materials such as plastic, rubber, cloth or thin metal around the outside, the inside, or both the inside and outside of the rim 14.

The body 10 is advantageously designed for cost effective manufacturability. The rim 14 can be fashioned from either a steel strap, wire coil or spring by using traditional rolling, welding, coiling or spin-making equipment. The material which makes up the cylinder 12 can simply be wrapped around the rim 14 by hand or by utilizing machines. Adhesion of the material to the rim 14 can be achieved by utilizing either glue or transfer tapes. The use of tape has the advantage of enabling the product to be sold in a disassembled kit form, if so desired. A rim with a section of transfer tape wrapped around the rim may be sold in ring form. A protective layer on the tape may then be removed, and a strip of stiff but rollable material is wrapped around the rim, and held by the adhesive. Injection molding and extrusion manufacturing processes also can be readily utilized.

Figure 4:
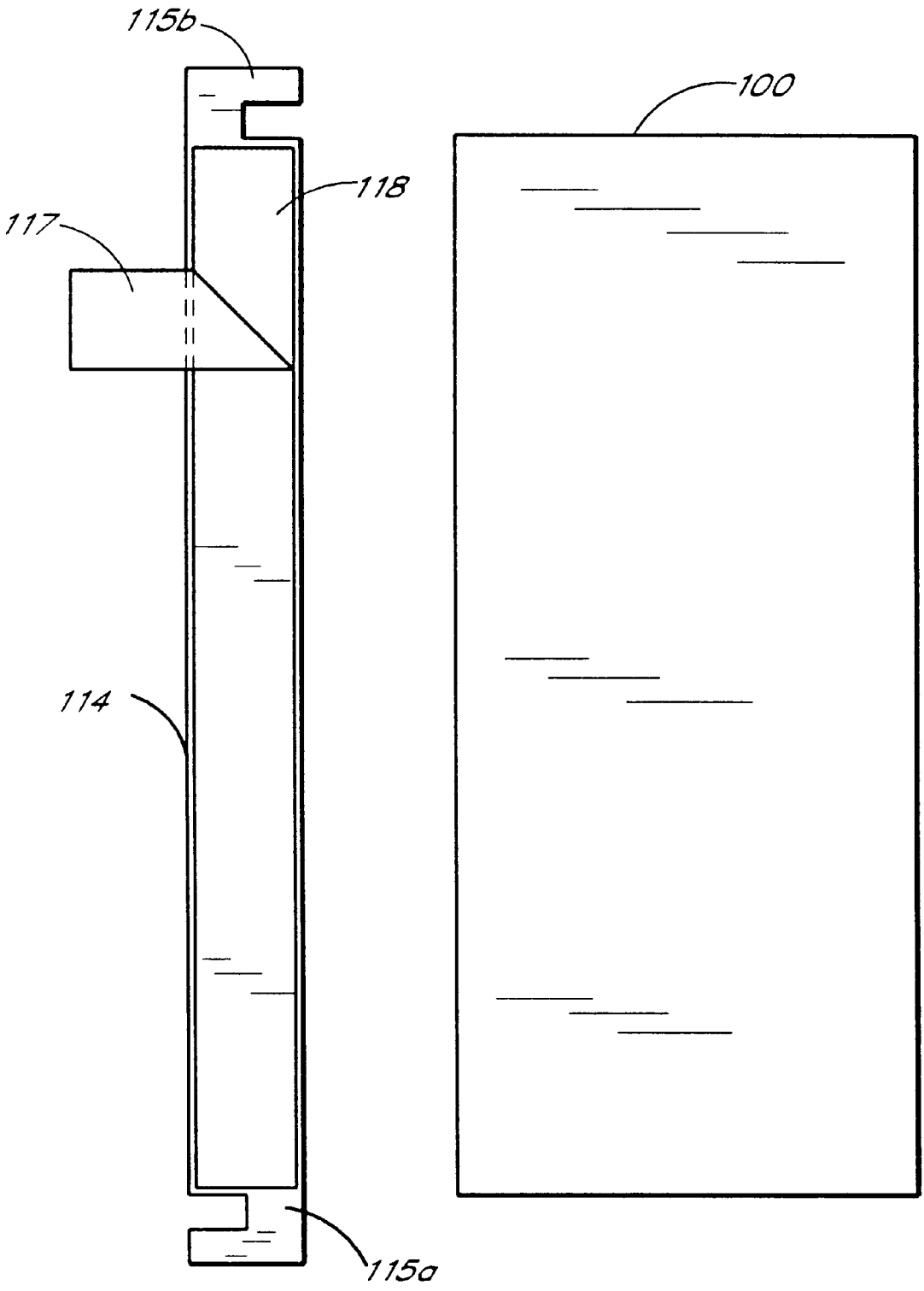
FIG. 4 is a plan view of one form of the toy before it is assembled.
Figure 5:
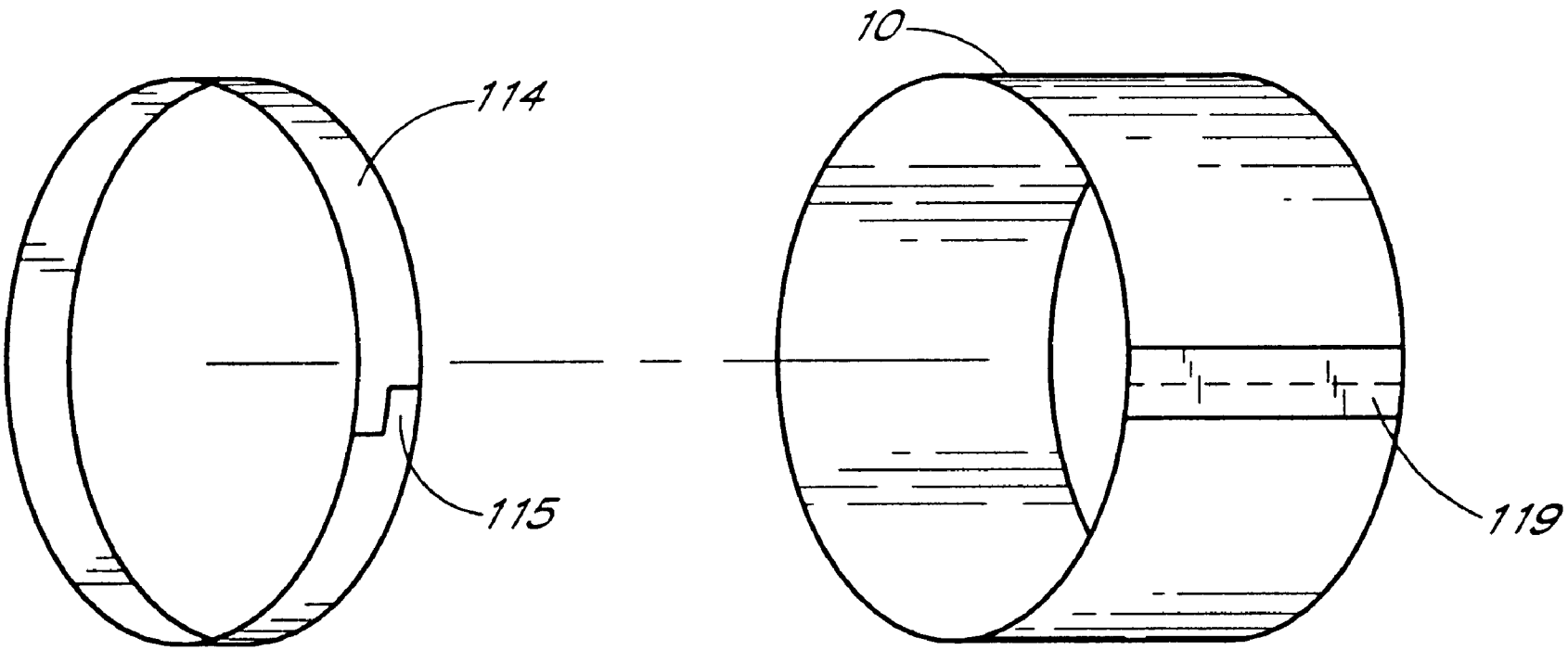
FIG. 5 is a perspective view illustrating a preferred manner in which the rim and the body of FIG. 4 may be assembled.

Referring to FIG. 4, the product can alternatively be sold with the rim 114 lying flat incorporating a buckling mechanism at opposite ends 115*a* and 115*b* and transfer tape 117 affixed to one side. The body 100 also would be sold flat. The product could be assembled by the end-user as follows: a protective layer 118 of the transfer tape 117 is removed from the flat rim 114 exposing the adhesive. The flat rim is taped to the leading edge of the body 100. The flat rim and body are then formed into a cylinder as seen in FIG. 5, whereby the rim is fastened into a circle by coupling the ends 115 of the rim. The rim is positioned on the inside of the cylinder and the spring tension of the rim naturally holds it and the body 10 in a circular fashion. A seam is formed with tape 119 along the cylinder's length when the body is fastened together.

In the particularly preferred embodiment of the toy of FIG. 1, the length of the rim 14 is 0.5 inches, which accounts for 23.5% of the body's 10 total length. A range of about 18% to 32% is satisfactory. The cylinder 12 and the rim 14 combination weighs approximately 26 grams. These dimensions provide excellent characteristics for a game of catch because of the following results: a straight and stable flight can be achieved for both long and short distances; the cylinder fits comfortably within the grip of an average sized man; the diameter of the cylinder is large enough to reduce the possibility of someone being inadvertently struck in the eye; and the cylinder's lightweight construction prevents serious harm if someone is accidentally struck.

With respect to length and diameter parameters, preferred embodiments provide the cylinder or "wing" portion with a diameter/length (D/L) ratio $\geqq 1.5$ (L/D<about 0.66). To place this in perspective, the particularly preferred embodiment of the toy of FIG. 1 provides cylinder 12 with a diameter of about 3.75 inches and a length of about 2.125 inches, giving a D/L ration of about 1.76.

With respect to wall thickness, the weighted portion of cylinder 12 preferably has a thickness of no more than about 0.4 inch, and both the leading edge and the trailing, non-weighted region have a thickness of no more than about 0.1 inch. In the particularly preferred embodiment of the toy of FIG. 1, the leading edge and the trailing portions of cylinder 12 have a thickness of about 0.01 inch, while the front rim portion, 14 has a wall thickness of about 0.040 inches.

The perimeter of the wing portion is presently considered to be important relative to the thickness of the body or "wing" portion of the device. The term "perimeter" is employed herein instead of the term "circumference" because the body need not be cylindrical. Instead, the body may have a polygonal, elliptical or some other regular or irregular cross section.

It is now contemplated that for toys or other embodiments, especially larger embodiments carrying payloads, preferred leading edge outside perimeter will be at least 600, 800, 1000, 2000, 3000 or even 4000 times the average thickness of the leading edge. Similarly, it is contemplated that the preferred leading edge outside perimeter will be at least 150, 200, 250, 500, 750 or even 1000 times the thickness of the thickest portion of the cylinder. To put this in perspective, the embodiment of FIG. 1 given immediately above, and disclosedy in the parent application, teaches the leading edge perimeter about 11.78" (pi times the diameter of 3.75"), and a leading edge thickness about 0.01". This provides a multiple of the perimeter relative to the leading edge thickness of about 1176. Table 1 compares this data with corresponding data for other devices and applications.

TABLE 1

| Device | Greatest Thickness ($T_g$) (mils) | Thickness of Body (T) (mils) | Perimeter (P) (Inches) | $P/T_g$ | P/T |
|---|---|---|---|---|---|
| Morrow US 3264776 | 155 | 30 | 9.42 | 60 | 314 |
| Klahn US 4151674 | 75 | 15 | 7.85 | 99 | 523 |
| Hill US 4246721 | 140 | 30 | 10.99 | 78.5 | 366 |
| Forti US 5816880 | 40 | 10 | 11.76 | 2.35 | 1176 |

The perimeter of the wing portion is also considered to be important relative to the overall length of the device. In particular, it is now preferred that the leading edge outside perimeter is a multiple, such as 4.7, 5.0, 7.5 or 10, of the length of the device. To put this in perspective, the parent application taught a preferred embodiment in which the leading edge outside perimeter was 11.78" and the length was 2.125", giving a ratio of 5.54.

In yet another aspect of preferred embodiments the leading edge outside perimeter measures at least 9 inches, 12 inches, 15 inches, 20 inches, or even larger. These large diameter cylinders or "wings" are contemplated to be especially useful when carrying payloads.

In yet another aspect of preferred embodiments, especially preferred embodiments also have an axial center of gravity positioned between the leading and following ends, wherein the center of gravity is at least 70%, 80% or 90% of the distance from the following end to the leading end.

All possible combinations of all of these limitations are contemplated. Thus, for example, it is contemplated that the leading edge outside perimeter may be at least 100 times the leading edge thickness, and at least 25 times the thickness of the thickest portion of the cylinder, and have an axial center of gravity positioned at least 70% of the distance from the following end to the leading end.

It will be recognized that body 10 can be launched by various known mechanical or powered mechanisms means which can aim and impart the initial velocity and spin conditions. Such means may be carried aboard a spinning device or may be externally separate. Included in these means are springs, catapults and other leverage mechanisms, explosive or burning propellant system, as well as normal powered devices running on electricity or various fuel systems.

Referring again to FIG. 1, it has been found that when properly thrown, the device will initially follow a substantially linear flight path from the initial direction 24. Rapid spinning imparts gyroscopic effects which tend to stabilize the flight path against the gravitational forces acting to rotate the heavy gyroscopic rim 14 downward about a horizontal axis 32. Toward the end of the flight, when the spinning and forward velocity diminish, the device will process from right to left about a vertical axis 26. The flight then will veer to the left along path 30. The end of flight is characterized by the rim nosing down accompanied by gyroscopic coring motions.

Figure 2:
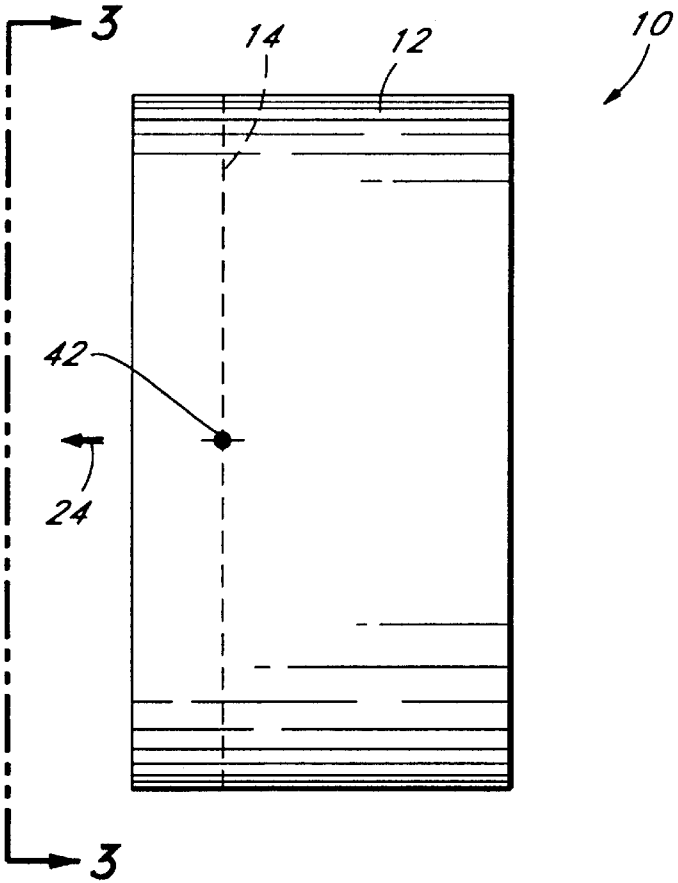
FIG. 2 is a side elevation view of the device of FIG. 1 depicting the x axis and showing the forward leading edge.

FIG. 2 shows a side view of the body 10 with the weighted, dense and balanced rim 14 oriented with its x axis along the direction of launch arrow 24. The rim portion 14 is comprised of a thin annular metal band attached to the leading edge of the internal wall of the cylinder 12. The body's center of gravity is shown at point 42.

Figure 3:
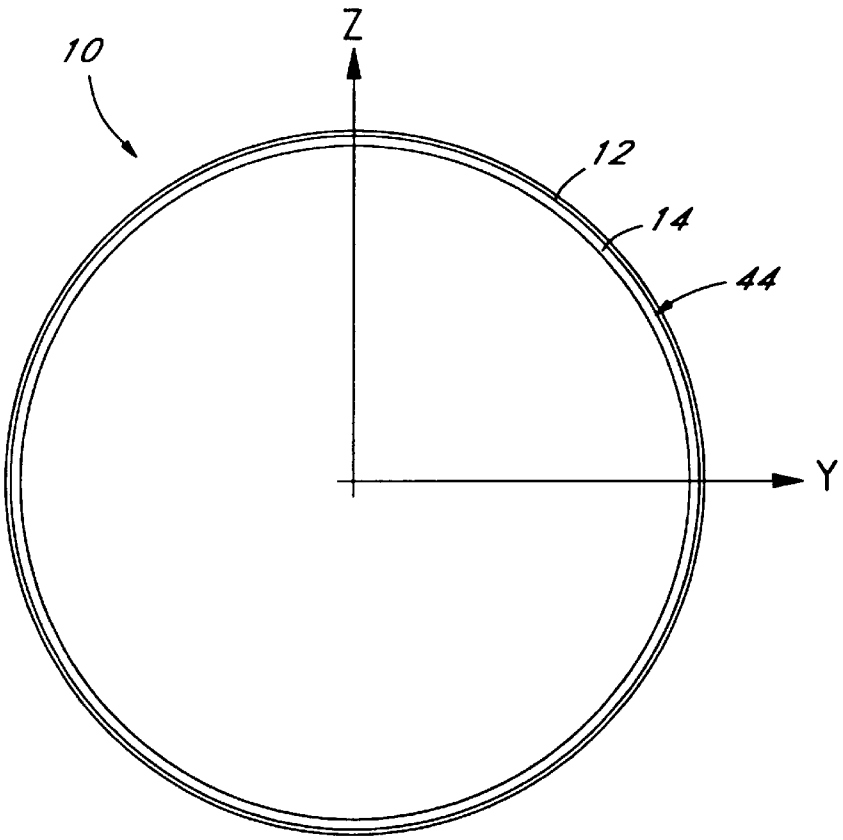
FIG. 3 is an end view of the device of FIG. 1 as seen from the leading edge.

FIG. 3 shows the front view of the body 10 corresponding to the line 3—3 of FIG. 2, with y and z axes exposed. Leading edge 44 is comprised of the rim 14 and the cylinder 12 has a-thickness of less than about 0.1 inch.

The performance of the body 10 is heavily dependent upon the weight of the rim 14. The weight of the rim 14 is preferably between 75% and 90% of the total weight of the body 10. Experiments have been performed to obtain these results. Comparative performance tests have been made which show the importance of appropriate up-front weighting to obtain significant gyroscopic effects and enhanced flight performance. Plastic models were used having body lengths of 2 inches and diameters of 3.75 inches. Various weighted metal rims with densities of 7.85 g/cm 3 have been added to the forward region along the leading edge. Table 2 below presents "normal thrown" averages of approximate flight ranges of devices with different rim weight percentages obtained under wind still conditions and an observation appraisal of flight characteristics.

TABLE 2

| % of Rim Weight to the Total Device | Average Normal Throw | Flight Characteristics |
|---|---|---|
| 51% | 15 Yds | Very wobbly spin, poor lift, does not soar, no precession. |
| 64% | 20 Yds | Wobbly spin, poor lift, does not soar, no precession. |
| 73% | 50 Yds | Rough spin, exhibits lift and soars somewhat, some precession. |
| 81% | 65 Yds | Smooth spin, exhibits good lift and soars well, precession. |
| 86% | 65 Yds | Very smooth spin, exhibits good lift and soars well, much precession. |
| 90% | 40 Yds | Noses down, much precession. |

To summarize, the table shows that performance unexpectedly and dramatically increases, as weighting increases to the range of 75% to 90% and then dramatically falls off above 90%.

Not only is rim weight important to performance, but density of the rim in proportion to overall body weight is also a key factor. To demonstrate this point, comparative performance tests have been made, which show the importance of rim density to obtain significant gyroscopic spinning and enhanced flight performance. As with the previously described tests, plastic models were used, each having a body length of 2 inches and a diameter of 3.75 inches. In this case, the weights of the rims were held constant at 17 grams, but the materials used had different densities. The overall weight was kept the same as indicated above, 26 grams. While this is a desirable weight for long distance throws, different weights can be employed so long as the other parameters are met, such as the rim weight and location, and rim density. Table 3 below presents "normal throw" averages of approximate flight ranges of devices with different rim densities obtained under wind-still conditions and observation appraisals of flight characteristics.

TABLE 3

| Material | Density to Total Weight | Average Normal Throw (Yards) | Flight Characteristics |
|---|---|---|---|
| Polycarbonate | 1 to 21.6 | 25 Yds | Wobbly spin, poor lift, unstable flight |
| Aluminum | 1 to 9.6 | 35 Yds | Rough spin, some lift, unstable flight |
| Tin | 1 to 4.5 | 56 Yds | Smoother spin, exhibits lift, more stable. |
| Steel | 1 to 3.3 | 65 Yds | Smooth spin, lifts very well, very stable flight. |
| Lead | 1 to 2.3 | 74 Yds | Smooth spin, very strong lift, very stable flight. |

It should be noted that this gyroscopic data confirms the expectation of improved distances and flight characteristics with increased forward rim weight distributions and density to weight make-up. As can be seen, rims of polycarbonate, which has a density of 1.2 grams per $cm^3$, or aluminum, having a density of 2.7 grams per $cm^3$, gave unsatisfactory performance. By contrast, tin, 5.75 $g/cm^3$; steel, 7.84 $gm/cm^3$; and lead 11.34 $gm/cm^3$ gave good results. Further experimentation has shown that a density to total weight ratio of less than about 1 to 8 is satisfactory.

Weight distributions of the present invention are determined without regard to aerodynamic modifications concerning the shape of the cylinder's wall. In contrast, prior art weight distributions are cited in conjunction with a variety of specific aerodynamic shape modifications. Nevertheless, weight distributions of previous designs are well below the criteria of having the rim account of 75% of the total weight, as indicated above. Furthermore, there is nothing in the prior art which reveals the importance of having high density material for making the rim. As indicated earlier, proper body trim factors must accompany the gyroscopic rim parameters to obtain the exceptional flight performance of the present invention. Therefore, previous designs cannot achieve sufficient gyroscopic stabilization to reach the greater ranges or smoother flight characteristics exhibited by the present invention. The superior design of the present invention over the prior art is dramatically evidenced in drastic performance improvement maximum ranges for "hard throws" of the present invention by a typical man can exceed 150 yards. By comparison, tests show that "hard throws" of Hill's actual device (which Hill claimed a considerable improvement overall previous patents) have rough flights and do not exceed 35 yards. Also, hard throws of McMahon's device show rough flights and do not exceed 30 yards.

Figure 6:
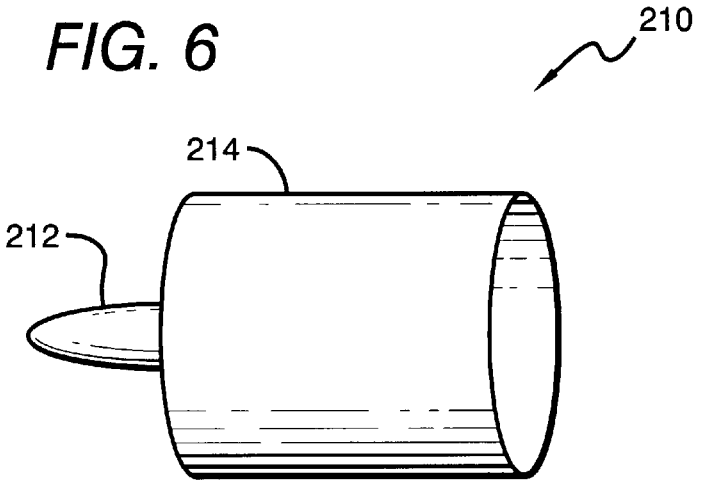
FIG. 6 is a perspective view of a military or commercial application of the present invention.

FIG. 6 depicts a military or commercial application of a free spinning gyroscopic device 210 in which a payload 212 is coupled to a cylindrical wing 214 as described elsewhere herein. In many instances such as where the payload is a hand grenade, the wing 214 may advantageously fold up into a stowed configuration, and unfold into a flight configuration. In the case of hand grenades, it is expected that devices including a wing portion as taught herein can be thrown many times the distance of presently available hand grenades.

Figure 7:
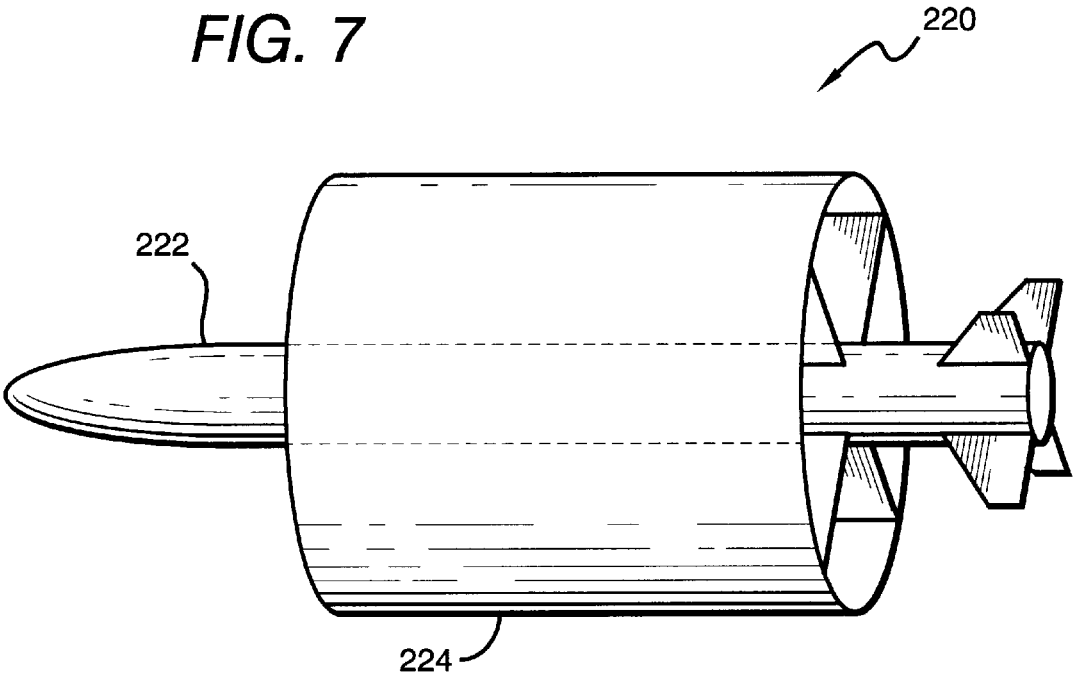
FIG. 7 is a perspective view of another military or commercial application of the present invention.

FIG. 7 depicts yet another military or commercial application of a free spinning gyroscopic device 220 in which a payload 222 is coupled to a cylindrical wing 224, but in a different manner than that shown in FIG. 6. Embodiments according to this example are contemplated to be especially useful in missile type payloads.

Although the present invention has been described in considerable detail with reference to certain preferred cylindrical aerial toy versions thereof, other versions and applications are possible. The present invention can be utilized in the defense industry as a bullet, projectile, mortar, target practice device, self-propelled aircraft, etc. Also, it may be used in the medium of water as a torpedo or submarine. Furthermore, various hollow body shapes and known aerodynamic modifications may also be spun and flown. Therefore, the spirit and scope of the appended claims should not necessarily be limited to the description of the preferred version sand applications contained herein.

We claim:

1. A free spinning gyroscopic device comprising a hollow body having leading and following open ends, an outer wall at the open end defining an outer perimeter, P, and having an average thickness, t, wherein $P \geqq 600$ T.

2. The device of claim 1 wherein $P \geqq 800$ T.

3. The device of claim 1 wherein $P \geqq 1000$ T.

4. The device of claim 1 wherein $P \geqq 2000$ T.

5. The device of claim 1 wherein the hollow body has an outer wall with a greatest thickness, $T_g$, and $P \geqq 150\ T_g$.

6. The device of claim 5 wherein $P \geqq 200\ T_g$.

7. The device of claim 5 wherein $P \geqq 250\ T_g$.

8. The device of claim 5 wherein $P \geqq 500\ T_g$.

9. The device of claim 1 wherein the hollow body has an outer wall with a greatest thickness, $T_g$, and $P \geqq 200\ T_g$.

10. A free spinning gyroscopic device comprising a hollow body having leading and following open ends, the hollow body having an outer wall with a greatest thickness, $T_g$, and the open end defining an outer perimeter, P, wherein $P \geqq 150\ T_g$.

11. The device of any of claims 1–10 further comprising an axial center of gravity positioned between the leading and following ends, wherein the center of gravity is at least 70% of the distance from the following end to the leading end.

12. The device of any of claims 1–10 further comprising an axial center of gravity positioned between the leading and following ends, wherein the center of gravity is at least 80% of the distance from the following end to the leading end.

13. The device of any of claims 1–10 further comprising an axial center of gravity positioned between the leading and following ends, wherein the center of gravity is at least 90% of the distance from the following end to the leading end.

14. The device of any of claims 1–10 further comprising a length, L, defined by the leading and the following ends, and an axial center of gravity positioned between the leading and following ends wherein $P \geqq 4.7$ L.

15. The device of any of claims 1–10 further comprising a length, L, defined by the leading and the following ends, and an axial center of gravity positioned between the leading and following ends, wherein $P \geqq 5$ L.

16. The device of any of claims 1–10 wherein $P \geqq 9$ inches.

17. The device of any of claims 1–10 wherein $P \geqq 12$ inches.

18. The device of any of claims 1–10 wherein $P \geqq 15$ inches.

19. The device of any of claims 1–10 wherein $P \geqq 20$ inches.

20. The device of any of claims 1–10 wherein $P \geqq 9$ inches, and further comprising an axial center of gravity positioned between the leading and following ends, wherein the center of gravity is at least 80% of the distance from the following end to the leading end.

* * * * *